US006463861B1

(12) United States Patent
Nottingham

(10) Patent No.: US 6,463,861 B1
(45) Date of Patent: Oct. 15, 2002

(54) ANTI-DRIFT RETARDER FOR GEAR OPERATED DOOR

(75) Inventor: Scot J. Nottingham, Greenville, PA (US)

(73) Assignee: YSD Industries Inc., Youngstown, OH (US)

( * ) Notice: Subject to any disclaimer, the term of this patent is extended or adjusted under 35 U.S.C. 154(b) by 0 days.

(21) Appl. No.: 09/896,176

(22) Filed: Jun. 29, 2001

(51) Int. Cl.[7] ..... B61D 17/00
(52) U.S. Cl. ..... 105/378; 49/220
(58) Field of Search ..... 105/250, 253, 105/258, 280, 286, 378; 292/16; 192/144, 223.1; 49/220

(56) References Cited

U.S. PATENT DOCUMENTS

| | | | | | |
|---|---|---|---|---|---|
| 3,413,758 | A | | 12/1968 | Palsson | |
| 3,488,074 | A | | 1/1970 | Herr | |
| 3,499,247 | A | * | 3/1970 | Madland | 49/220 |
| 3,512,484 | A | * | 5/1970 | Madland et al. | 105/378 |
| 3,555,731 | A | | 1/1971 | Ross, Jr. | |
| 3,660,938 | A | * | 5/1972 | Ross et al. | 49/220 |
| 3,776,581 | A | * | 12/1973 | Ross, Jr. | 292/39 |
| 4,064,810 | A | | 12/1977 | Jenkins et al. | |
| 4,172,609 | A | * | 10/1979 | Marsh | 292/224 |
| 4,319,429 | A | | 3/1982 | Seitz | |
| 4,631,778 | A | * | 12/1986 | Kocon et al. | 16/337 |
| 4,920,894 | A | * | 5/1990 | Thoman | 105/378 |
| 5,195,210 | A | * | 3/1993 | Lee | 16/54 |
| RE35,925 | E | | 10/1998 | Dohr et al. | |
| 6,070,641 | A | * | 6/2000 | Budetti | 160/302 |

* cited by examiner

*Primary Examiner*—S. Joseph Morano
*Assistant Examiner*—Frantz F. Jules
(74) *Attorney, Agent, or Firm*—Fay, Sharpe, Fagan, Munnich & McKee, LLP

(57) ABSTRACT

A railcar door assembly includes a drive mechanism operably connected to elongated support members for selectively imparting rotation of movement thereto, and a retarder assembly for preventing movement of the drive mechanism beyond defined limits. The drive mechanism includes a gear segment mounted on a bearing plate, and the retarder assembly is comprised of a pin and a retarder block. The pin extends through openings in each of the retarder block and bearing plate. The gear segment is rotated until a lobe of the gear first contacts and then compresses the block, thereby preventing further rotation of the gear segment. This arrangement effectively prevents undesired drifting of a railcar door into the side of the railcar itself.

22 Claims, 3 Drawing Sheets

SECTION: A-A

SECTION: A-A

SECTION: A-A

ANTI-DRIFT RETARDER FOR GEAR OPERATED DOOR

BACKGROUND OF THE INVENTION

The present invention relates generally to the art of railway cars. More particularly, the invention pertains to anti-drift retarders for gear operated plug-type doors for railway cars.

The invention is particularly applicable to plug-type metal doors of the type used on railway freight cars and will be particularly described with reference thereto. However, it will be appreciated by those skilled in the art that the invention has broader applications and is adaptable to use on doors of other types and in other environments.

Rectangular metal doors of a known type used in railway cars include a generally rectangular frame generally comprised of top, bottom, horizontal stiffeners, and opposed side members. Metal panels are secured to these frame members for completing the basic door construction. In most conventional railway cars, the frame members and metal panels are riveted and/or welded together.

Railway car doors are typically classified as either sliding doors or plug doors. Of the two, sliding doors are less complex, merely having a door configured to slide back and forth within a side panel of a railway car to selectively open and close an opening defined therein. Plug doors are more complex in that they are configured to first move laterally outward from the opening defined in the railcar, and then move longitudinally along a track disposed adjacent the railcar side panel. The present invention finds particular application to plug-type doors. However, it should be understood that the concept involved is equally applicable to other environments where selective movement of large doors between open and closed positions is required.

Plug doors to be mounted on the side of a railcar typically include a series of panels or sheeting reinforced by horizontally disposed channels at the top, bottom and intermediate portions of the door. A pair of vertically oriented elongated support members such as pipes, rods or bars are configured to support the door on the railcar. The support members are typically provided with upper and lower cranks attached to the ends thereof which serve as lever arms for laterally moving the door into and out of the railcar door opening. Upon actuation of a driving means, such as a manually operated gear assembly, the support members are rotated for causing corresponding rotation of the cranks. Rotation of the cranks, in turn, draws the door laterally outward from the door opening until the door is supported on a track disposed adjacent the side of the railcar. The door is moveably supported on the track by roller hangers which enable the door to slide longitudinally along the side of the railcar.

One problem that occurs when the door is drawn or moved onto the track is that the support members have a tendency to rotate, thus causing the door to drift back into the side of the railcar. If this occurs, the ability of the door to slide longitudinally along the track may be inhibited. Furthermore, the door or the side of the railcar may become damaged because of the drifting action.

Accordingly, it has been considered desirable to develop an anti-drift retarding device for a gear-operated do or that addresses the foregoing difficulties and others while providing better and more advantageous overall results.

SUMMARY OF THE INVENTION

In accordance with the present invention, an anti-drift retarder for a gear-operated door is advantageously provided.

The retarder is particularly suited for use with a railcar door assembly comprised of at least one sheet member having a front surface, channels laterally disposed on the front surface of the sheet member, and a pair of elongated support members rotatably mounted to the channels via a mounting mechanism. Each support member includes a first rotatable member attached to a support member first end, and a second rotatable member attached to a support member second end. A drive mechanism is operably connected to the pair of elongated support members for selectively imparting rotational movement thereto. A retarder assembly for preventing movement of the drive mechanism is mounted on the sheet member adjacent the drive mechanism.

The first and second rotatable members may each comprise a crank with a roller assembly attached at one end thereof. The rollers, in turn, are mounted on the track of an associated railcar for moving the railcar door therealong.

An operating mechanism is operably connected to the drive mechanism for selectively imparting rotation thereto. The operating mechanism comprises a shaft rotatably supported on the front surface of the sheet member and an activating member, such as a handle, secured to the shaft. A pair of transmission members are connected at a first end to the drive mechanism and at a second end to one of the elongated support members.

The drive mechanism may comprise a gear segment having a lobe. This gear segment is mounted on a bearing plate located on the sheet member. The drive mechanism further includes a pair of operating cams operably connected to both the gear segment and the transmission members.

The retarder assembly comprises a pin and a retarder block. The retarder block is attached to an upper corner of the bearing plate via the pin extending through openings in both the retarder block and bearing plate. The retarder block is captured between the bearing plate and a cover plate which is parallel to and spaced apart from the bearing plate. Preferably, the retarder block is fabricated from urethane or another hard, compressible material.

Rotation of the activating member or handle rotates the gear segment, thus causing rotation of the transmission and support members. The gear segment rotates until the lobe contacts and then compresses the retarder block, thus preventing further rotation of the gear segment.

A principal advantage of the present invention resides in the provision of an anti-drift retarding device for restricting a movable door from undesired and uncontrolled drifting into the side of an associated railcar.

Another advantage of the invention is found in the provision of an anti-drift retarder that enables the door to slide along a door track with minimal difficulty.

Yet another advantage of the present invention is the provision of an anti-drift retarder that helps prevent damage to a door and/or the side of a railcar due to door drifting.

Still another advantage of the invention resides in the provision of an anti-drift retarder that is relatively low in cost.

Yet another advantage of the invention is the provision of an anti-drift retarder that is easy to manufacture and retro-fit onto existing railcar doors.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENT

Figure 1A:
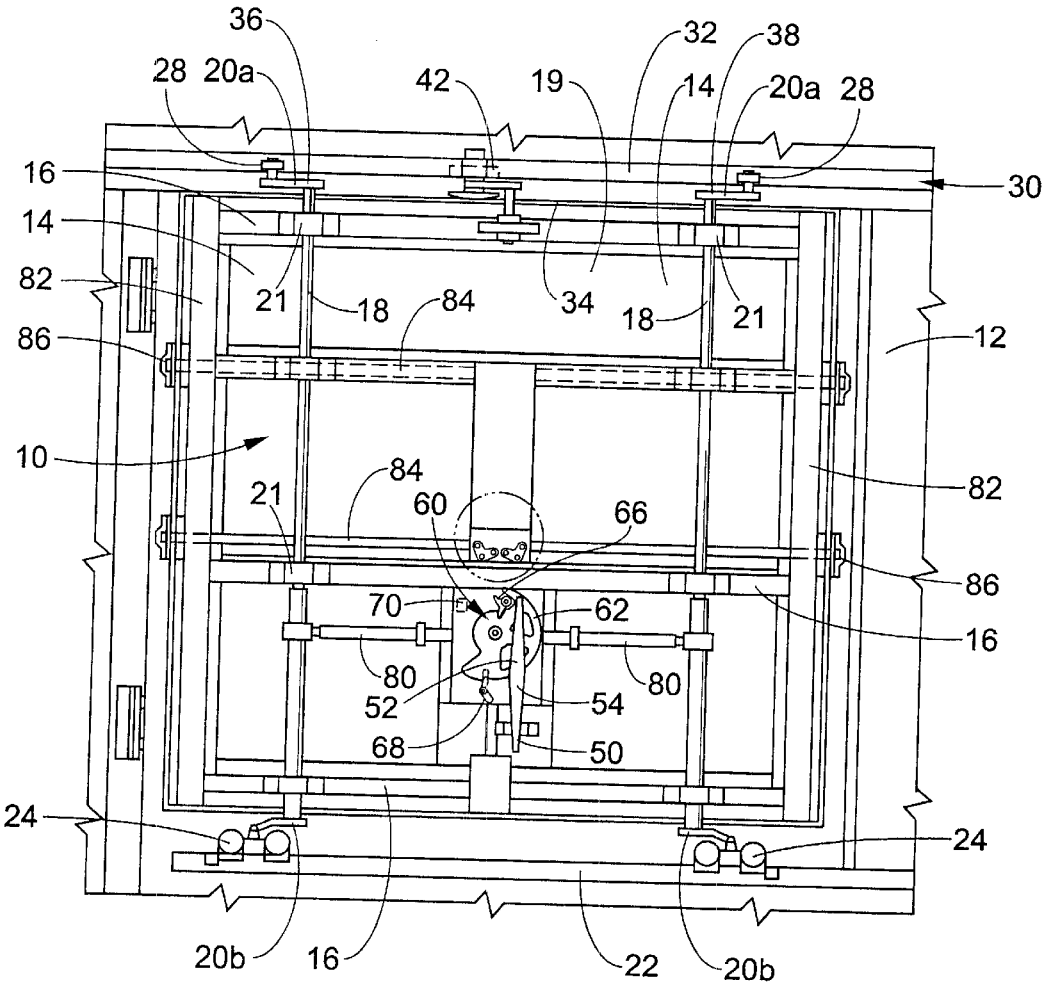
FIG. 1A is a front elevational view of a railcar door formed in accordance with the preferred embodiment of the present inventions.

Referring now to the drawings wherein the showings are for purposes of illustrating preferred embodiments of the invention only and not for limiting same, FIG. 1A shows a plug-type railcar door 10 disposed in an opening 12 in a railcar in accordance with the preferred embodiment of the present invention. The door includes a wall of paneling or sheeting 14 reinforced with horizontal channels 16 extending across top, bottom and intermediate portions of the sheeting. The sheeting 14 is typically fabricated from metal sheeting.

The door 10 is supported by a pair of elongated support members 18, such as pipes, rods or tubes, which are disposed along the vertical height of the door. The support members are rotatably mounted to the horizontal reinforcing channels 16 on an outer surface 19 of the door via brackets or fulcrums 21 located near the side edges of the door to retain the support members in a vertical disposition.

Each of the support members 18 includes a first or upper end having a first or upper crank 20*a* operatively connected thereto and a second or lower end having a second or lower crank 20*b* operatively connected thereto. The cranks 20*a*, 20*b* serve as lever arms which enable the door to move laterally into and out of the railcar opening 12. The door 10 is adapted to move laterally out of the door opening toward the outside of the railcar until the door is supported on a track 22 disposed adjacent the railcar side wall. The door moves longitudinally along the side of the car on track 22 to effectively open the door opening to facilitate car loading and unloading. Thus, when it is in the unplugged position, the door is movably supported on the track 22 by roller hangers 24 which are attached to the ends of the lower cranks 20*b* for guiding the door during its longitudinal movement.

Upper ends of cranks 20*a* include pins with rollers 28 mounted for longitudinal movement within and along a top retainer rail or longitudinal retainer member 30 having a generally c-shaped cross-section. The top retainer rail 30 is mounted along the top of the door opening 12 and functions to restrain the top of the door and prevent its undesirable displacement. Rollers 28 move along an inner surface of a downwardly depending front flange 32 of the top retainer rail. The front flange extends longitudinally and is located inside an outer edge of a laterally outward extending lower flange 34 spaced from and located below the front flange. Horizontal connecting portions 36, 38 of upper cranks 20*a* extend through the space between front flange 32 and lower flange 34, and connect the upper ends of the cranks and their rollers 28 with the upper ends of support members 18. The rollers 28 are disposed behind the retainer rail 30. The combination of the rollers 28 and the retainer rail 30 acts to restrain the top of the car door 10 as it is moved longitudinally along the track 22.

Mounted on the top of the door between the pair of upper cranks 20*a* is an auxiliary crank 42. The purpose of the auxiliary crank is to restrain the door against undesirable displacement in the event it becomes disengaged from track 22 or is damaged in a manner which makes reliance on the upper cranks 20*a* difficult.

As is well understood in the art, rotation of the support members 18 will cause a corresponding outward rotation of the cranks 20*a*, 20*b* to sequentially draw the door 10 laterally outward from the door opening. An operating mechanism 50 is provided on the door for controlling the rotation of the support members 18 and the cranks. The operating mechanism includes a shaft 52 which is rotatably supported on outer surface 19 of the sheeting 14. An activating member 54 in the form of a handle is secured to the shaft 52.

Figure 2B:
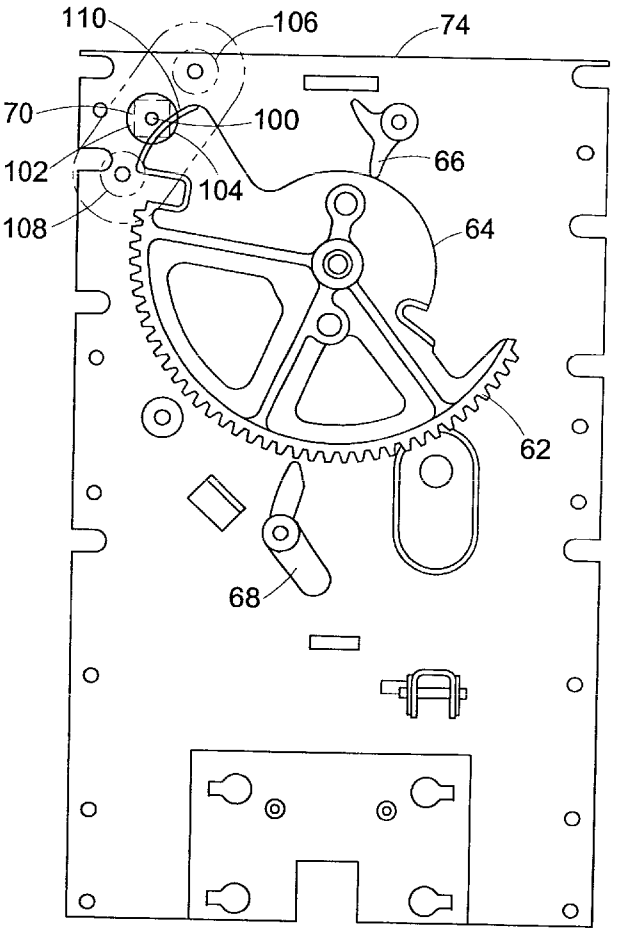
FIG. 2B is an elevational view similar to FIG. 2A showing the position of the components when the railcar door is in the fully opened position.
Figure 2A:
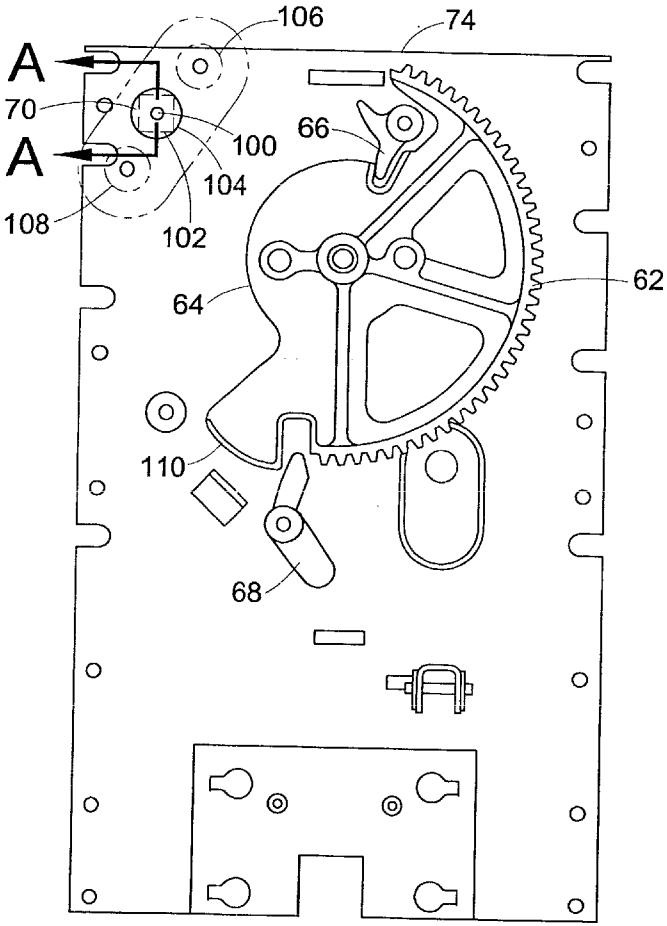
FIG. 2A is an elevational view of a gear assembly, a bearing plate and an anti-drift retarder assembly when the associated railcar door is disposed in the fully closed position.

A drive mechanism 60 preferably comprises a gear operated system or assembly 62 which is connected to and actuated via the activating member or handle 54. Referring to FIGS. 1A, 2A and 2B, the gear assembly includes a gear segment 64, two operating cams 66, 68 and a retarder or locking assembly 70, each of which is housed in and positioned between cover and bearing plate 72, 74. The bearing plate 74 is mounted on a lower portion of the door sheeting 14, and the cover plate 72 is bolted or mounted to the bearing plate 74. The cover plate is disposed parallel to and spaced apart from the bearing plate.

Referring to FIG. 1A, a pair of transmission members 80, such as pipes, rods or tubes, are connected at first ends to the drive mechanism 60 and at second ends to support members 18. The transmission members are connected to operating cams 66, 68 of the gear assembly 62. By rotating the handle 54 counter-clockwise, the shaft 52 rotates the gear segment 64 clockwise which, in turn, rotates the operating cams 66, 68 which are connected to and rotate the transmission members 80. This, then, imparts a corresponding rotation to the support members 18 and cranks 20*a*, 20*b* which, in turn, provides selective lateral movement of the door outwardly from the opening 12 toward the outside of the railcar.

When the handle 54 is rotated clockwise, the gear segment 64 rotates counter-clockwise to rotate operating cams 66, 68 and transmission members 80. This, in turn, rotates the support members 18 and cranks 20*a*, 20*b* to provide lateral movement of the door 10 into the opening 12 of the railcar. Such movement allows the door to seal or plug the opening.

The channels 16 are operatively connected at their axial ends to opposed vertical members 82. A pair of locking rods 84 extend horizontally across the railcar door and are configured to be received in openings 86 in the car. While the door is in the closed position, and as shown in FIG. 1A, the locking rods 84 extend into openings 86, thereby preventing lateral movement of the door.

Figure 1B:
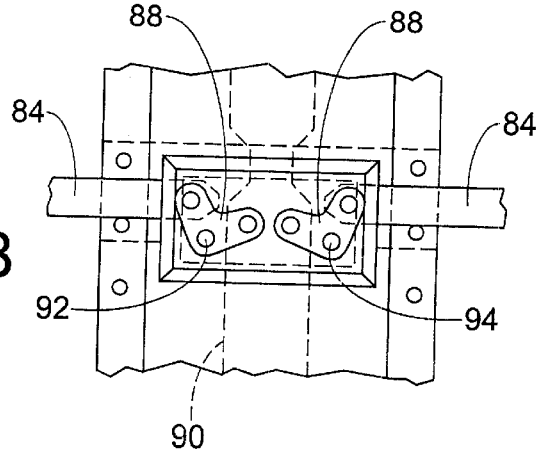
FIG. 1B is an enlarged elevational view of the encircled area of FIG. 1A showing an operating cam assembly for the railcar door.

With reference to FIG. 1B, the locking rods are split at an intermediate portion and are interconnected via operating cams or links 88 and an operating bar 90. The operating bar is coupled to the drive mechanism 60 which, when actuated, causes cams or links 88 to rotate about pivot joints 92, 94. Such rotation of the cams pulls the locking rods 84 from openings 86 and places the door in an unlocked position where it is then free to move in the lateral direction.

Referring to FIGS. 2A and 2B, the retarder or locking assembly 70 is comprised of a retarder pin 100 and a retarder block 102. The retarder block is positioned and captured between the cover plate 72 and bearing plate 74 at generally upper corners thereof. The retarder block 102 is retained in place by the pin 100 extending through an opening in the retarder block and through a corresponding opening in the bearing plate. Preferably, the retarder block is cylindrical and is comprised of urethane or a similar hard, compressible material having a durometer hardness of 90 or so. The purpose of the retarder is to restrict movement of the door from undesired and uncontrolled drifting into the side of the railcar. As shown in phantom in FIGS. 2A and 2B, the retarder may be located in various positions 104, 106, 108. The positions vary depending upon the amount of gear rotation necessary to fully open and close the door.

When the door is opened, the gear segment 64 will be rotated clockwise, and a lobe 110 on the segment will physically contact the retarder block 102. In this position, and as seen in FIG. 2B, the lobe compresses and slightly deforms the retarder block. As the lobe contacts the block, the block may rotate about pin 100 until it begins to compress. The gear will continue rotating until the retarder block restrains further movement or rotation. This, then, prevents the door from drifting back into the side of the railcar.

Once the door is moved on the track 22, the support members 18 have a tendency to rotate, thus rotating the cranks 20*a*, 20*b* and thereby potentially allowing the door to move toward the side of the railcar. When the door is completely opened, the retarder block 102 must go past a centerline of the gear segment lobe 110 for the anti-drift to operate properly. If the lobe does not progress beyond its centerline with respect to the retarder, the gear member may start to rotate counterclockwise and allow the door to drift toward the side of the railcar.

Figure 2C:
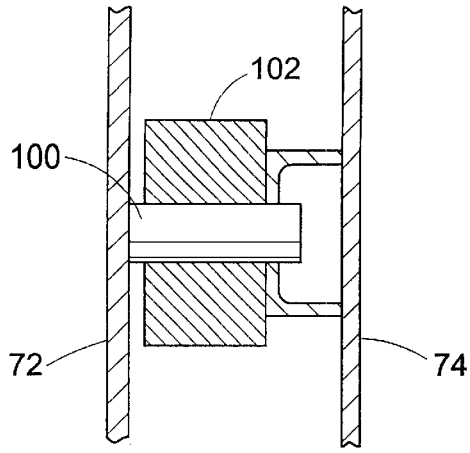
FIG. 2C is an enlarged view taken along lines A—A of FIG. 2A illustrating one embodiment of the anti-drift retarder.
Figure 2D:
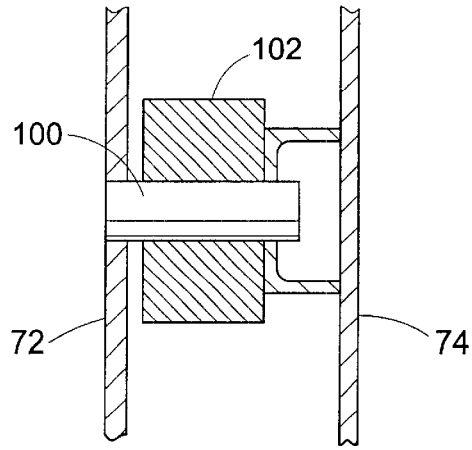
FIG. 2D is an enlarged view taken along lines A—A of FIG. 2A illustrating a second embodiment of the anti-drift retarder; and, FIG. 2E is an enlarged view taken along lines A—A of FIG. 2A illustrating a third embodiment of the anti-drift retarder.
Figure 2E:
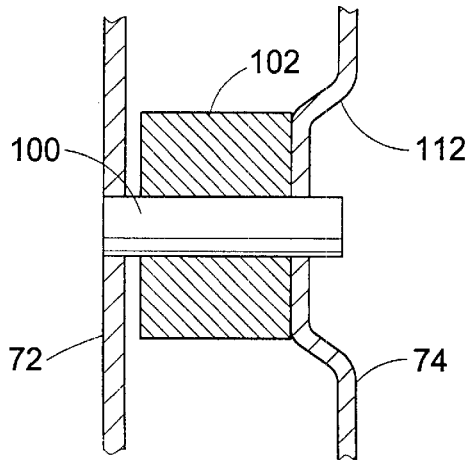

As shown in FIGS. 2C, 2D and 2E, the retarder assembly itself may take several alternative conformations. As seen in FIG. 2C, the retarder pin 100 extends through openings in each of the retarder block 102 and bearing plate 74. The pin is lodged or captured between the bearing plate and the cover plate 72.

In another embodiment as shown in FIG. 2D, the pin 100 extends through the retarder block 102 and also through openings in the cover and bearing plate 72, 74. The extension of the pin through the hole in the cover plate provides additional rigidity for the overall construction. FIGS. 2C and 2D illustrate retarder assemblies which could be retro-fit into an existing gear assembly.

In a third embodiment as shown in FIG. 2E, the retarder pin 100 extends through openings in the cover plate 72 and in a slightly modified bearing plate 74. The bearing plate is made with a channel 112 specifically to support the retarder pin and block. In this embodiment, the retarder pin and block are slightly larger than those used in the other embodiments.

The invention has been described with reference to the preferred embodiments. Obviously, modifications and alterations will occur to others upon a reading and understanding of this specification. The invention is intended to include all such modifications and alterations in so far as they come within the broad meaning and scope of the appended claims.

Having thus described the preferred embodiments, the invention is now claimed to be:

1. A railcar door assembly comprising:

at least one sheet member defining a front surface;

at least one elongated support member rotatably mounted to said front surface;

a drive mechanism operably connected to said elongated support member for rotating said support member about its length; and, a locking assembly comprising a retarder block to prevent drifting of said door from a fully opened position, said locking assembly being mounted on said sheet member adjacent said drive mechanism.

2. The railcar door assembly of claim 1, wherein said drive mechanism comprises a gear segment having a lobe, said gear segment being mounted on a bearing plate located on said front surface of said sheet member.

3. A railcar door assembly comprising:

at least one sheet member defining a front surface;

at least one elongated support member rotatably mounted to said front surface;

a drive mechanism operably connected to said elongated support member for rotating said support member about its length, said drive mechanism comprising a gear segment having a lobe and being mounted on a bearing plate located on said front surface of said sheet member; and, a locking assembly for preventing movement of said drive mechanism when said door is in a fully opened position, said locking assembly being mounted on said sheet member adjacent said drive mechanism; wherein said locking assembly comprises a pin and a retarder block, wherein said pin extends through an opening in said retarder block and through an opening in said bearing plate to retain said block to said bearing plate.

4. The railcar door assembly of claim 3, further comprising a cover plate spaced from and mounted to said bearing plate, wherein said gear segment and said locking assembly are interposed between said bearing plate and said cover plate.

5. The railcar door assembly of claim 3, wherein said retarder block is comprised of urethane.

6. The railcar door assembly of claim 3, further comprising an operating mechanism operably connected to said drive mechanism for selectively rotating said drive mechanism.

7. The railcar door of claim 6, wherein said operating mechanism comprises a shaft rotatably supported on said front surface of said sheet member and an activating member secured to said shaft.

8. The railcar door of claim 7, further comprising at least one transmission member connected at a first end to said drive mechanism and at a second end to said elongated support member.

9. The railcar door assembly of claim 8, wherein rotation of said activating member rotates said gear segment for causing rotation of said transmission member and said support member.

10. The railcar door assembly of claim 9, wherein when said railcar door is moved to a fully opened position, the lobe on said gear segment contacts said retarder block and compresses and slightly deforms said block for preventing further rotation of said gear segment.

11. A railcar door assembly comprising:

at least one sheet member comprising a front surface;

at least one channel laterally disposed on said front surface of said at least one sheet member;

at least one elongated support member rotatably mounted to said at least one channel via a mounting mechanism, said support member comprising at least one rotatable member attached to an end of said support member;

a gear segment operably connected to said at least one elongated support member for rotating said support member, said gear segment having a lobe, said gear segment being mounted on a bearing plate located on said front surface of said at least one sheet member;

a locking assembly for preventing movement of said gear segment when said door is shifted to a predetermined fully opened position, said locking assembly comprises a pin and a retarder block, wherein said pin extends through an opening of said retarder block and through an opening in said bearing plate to secure said block to said bearing plate; and a cover plate spaced and mounted in spaced relation to said bearing plate, wherein said gear segment and said locking assembly are interposed between said bearing plate and said cover plate.

12. The railcar door assembly of claim 11, wherein said retarder block is comprised of urethane.

13. The railcar door of claim 11, further comprising an operating mechanism operably connected to said gear segment for rotating said gear segment.

14. The railcar door assembly of claim 13, wherein said gear segment is rotated until said railcar door is moved to a fully opened position, said lobe contacts said retarder block at a position beyond its centerline with respect to said block, thus compressing and slightly deforming said block.

15. The railcar door assembly of claim 11, wherein said at least one rotatable member comprises a crank with at least one roller attached at one end thereof.

16. The railcar door assembly of claim 15, wherein said at least one roller is mounted on an associated track of a railcar for moving said railcar door along said track.

17. An anti-drift locking assembly for use with an associated railcar door system including an associated bearing plate located on a front surface of a door, an associated cover plate spaced and mounted in spaced relation to said bearing plate, and an associated gear segment mounted to said bearing plate and interposed between said bearing plate and said cover plate with said gear segment selectively rotating said door to a fully opened position, said locking assembly comprising:

a retarder block mounted to said associated bearing plate and between said associated bearing plate and cover plate, said block preventing drifting of said door after said door is shifted to a predetermined fully opened position.

18. An anti-drift locking assembly for use with an associated railcar door system including an associated bearing plate located on a front surface of a door, an associated cover plate disposed in spaced relation to said bearing plate, and an associated gear segment mounted to said bearing plate and interposed between said bearing plate and cover plate with said gear segment selectively rotating said door to a fully opened position, said locking assembly comprising:

a retarder block mounted to said associated bearing plate and between said associated bearing plate and cover plate, said block preventing further movement of said associated gear segment when said door is shifted to a predetermined fully opened position, wherein said block is secured to said associated bearing plate by a pin which extends through openings in each of said block and said bearing plate.

19. The anti-drift locking assembly of claim 18, wherein said retarder block is comprised of urethane.

20. The anti-drift locking assembly of claim 18, wherein said pin further extends through an opening in said associated cover plate.

21. The anti-drift locking assembly of claim 18, wherein said retarder block is compressed and slightly deformed upon contact with said associated gear segment.

22. An anti-drift locking assembly for use with an associated railcar door system including an associated bearing plate located on a front surface of an associated railcar door, an associated cover plate spaced and mounted in spaced relation to said bearing plate and an associated gear segment mounted to said associated bearing plate and interposed between said bearing and cover plates, said locking assembly comprising:

a retarder block positioned between said associated bearing plate and said associated cover plate and adjacent said associated gear segment, said block is attached to said bearing plate by a pin which extends through a hole in said block and a hole in said bearing plate, wherein said block is compressed and slightly deformed upon contact with said associated gear segment when said gear segment rotates during movement of said door to a predetermined fully opened position, thus preventing further movement of said gear segment.

* * * * *